United States Patent [19]

Romberg

[11] 3,977,457

[45] Aug. 31, 1976

[54] OPENABLE GATE END FOR WIRE TRACTION GATE

[76] Inventor: Felix B. Romberg, P.O. Box 218, Holland, Tex. 76534

[22] Filed: Apr. 10, 1974

[21] Appl. No.: 459,810

Related U.S. Application Data

[63] Continuation-in-part of Ser. No. 270,308, July 10, 1973, Pat. No. 3,825,053.

[52] U.S. Cl. ..... 160/328; 292/247

[51] Int. Cl.[2] ..... E06B 3/80

[58] Field of Search ..... 160/327, 328; 292/246, 292/247; 49/381, 386, 394

[56] References Cited

UNITED STATES PATENTS

| | | | |
|---|---|---|---|
| 259,194 | 6/1882 | Morrow | 160/328 |
| 475,867 | 5/1892 | Hult | 160/328 |
| 963,447 | 7/1910 | Leonard | 160/328 |

*Primary Examiner*—Dennis L. Taylor
*Attorney, Agent, or Firm*—Richards, Harris and Medlock

[57] ABSTRACT

An openable gate end for wire traction gates includes a gate end standard comprising a U-shaped structural element having an open side and two broad parallel side walls extending from the open side and joined at their opposite sides by a narrow perpendicular wall forming a narrow closed side. A short angle member extends below the bottom of the narrow closed side of the standard to receive a seat bolt secured to the adjacent gate post. The upper end of the standard comprises an integral pivot block which receives the traction lever of a traction mechanism utilized to apply tension to the gate.

The openable gate end further comprises a plurality of links each pivotally supported between the side walls of the U-shaped gate end standard. Each wire comprising the traction gate is individually connected to one of the links. By this means the wires force the gate end standard into its proper orientation as the gate is closed.

3 Claims, 9 Drawing Figures

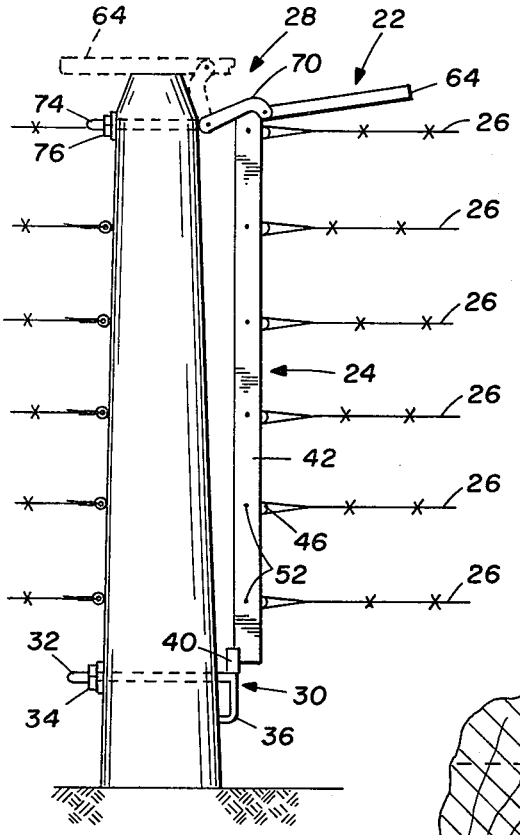
FIG. 1
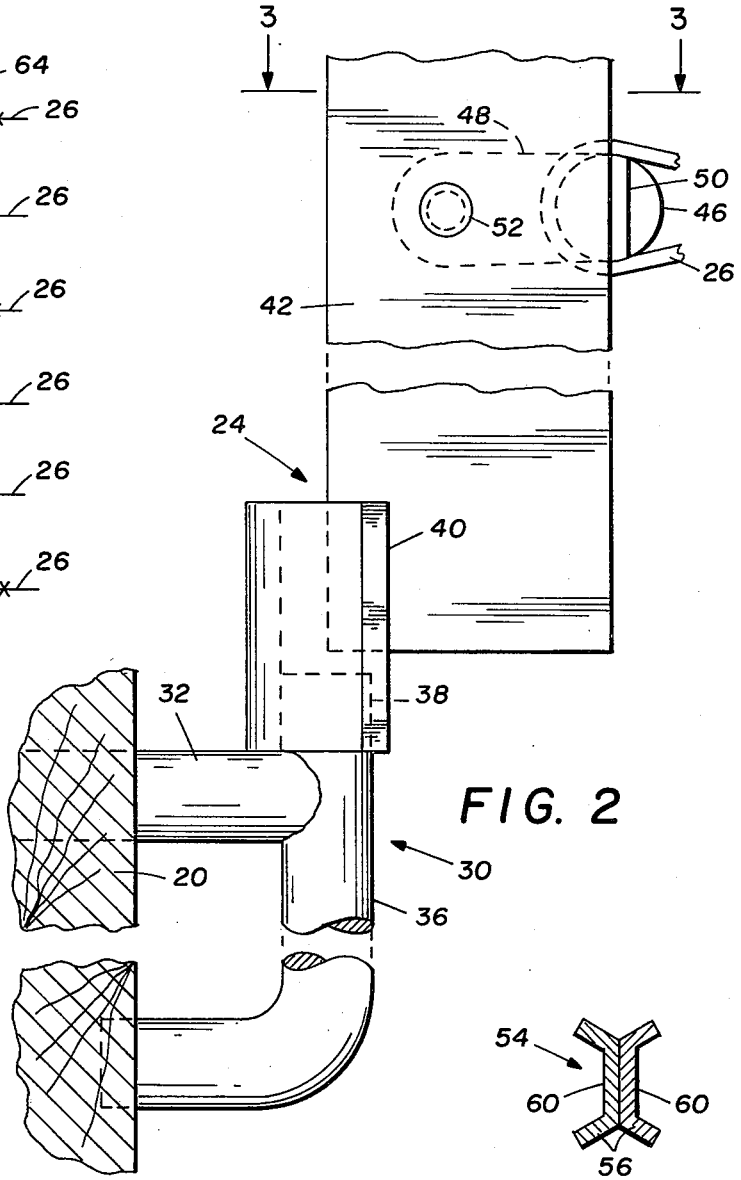
FIG. 2
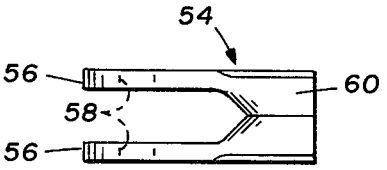
FIG. 4
FIG. 6
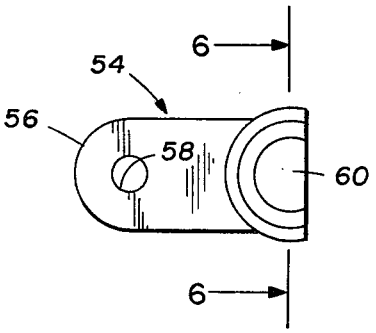
FIG. 5
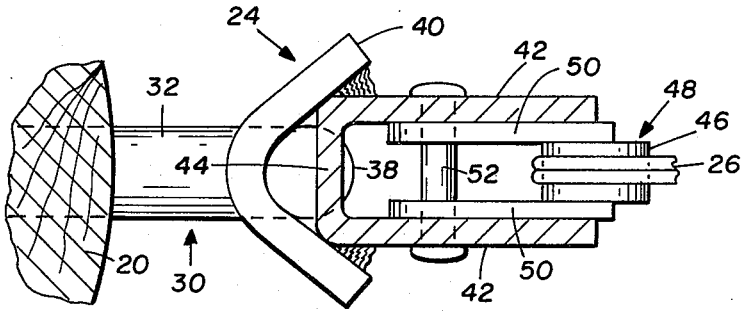
FIG. 3

OPENABLE GATE END FOR WIRE TRACTION GATE

CROSS REFERENCE TO RELATED APPLICATION

This application is a continuation-in-part of co-pending application Ser. No. 270,308, filed July 10th, 1973, for TRACTION GATE, now U.S. Pat. No. 3,825,053.

BACKGROUND AND SUMMARY OF THE INVENTION

In cross section the present gate end standard is a U-shaped structural element having an open side between two broad parallel side walls which are joined opposite the open side by a narrow perpendicular wall forming a narrow closed side. Pivoted inside this structural element and extending through its open side are links to each of which one of the longitudinal gate barrier wires is anchored for tensioning.

Straddling and extending below the bottom of the narrow closed side of the standard is a short integral angle member which hooks and is pivotal about an upstanding projection of a seat bolt secured to the adjacent gate post. The spreading sides make it easy to hook the angle bar to the projection when the gate is being closed and also insure unhooking if the gate end standard is allowed to drop while its lower end is still connected to the seat bolt.

An important advantage of the present open sided gate end standard is that the upper ends of the broad side walls perform three important functions for the operation of a preferred toggle type traction mechanism mounted on the supporting gate post, namely:

they support an integral interconnecting pivot block on the nearest side to the post for receiving the traction lever of the traction mechanism;

they are shaped at the farthest side from the gate post to terminate the movement of the traction mechanism after it has passed over center in toggle action; and they are perforated along with the traction lever to receive an interlocking pin which prevents both accidental opening of the gate and uplifting of the gate end standard.

DESCRIPTION OF THE DRAWINGS

For a more complete understanding of the present invention and its objects and advantages reference may now be had to the following Detailed Description taken in conjunction with the accompanying drawings in which:

FIG. 1 is a side elevation of the closed position of an openable wire traction gate end embodying the invention, with the post overlying position of the traction lever represented by dashed lines;

FIG. 2 is a detailed fragmentary side view of the lower part of the gate end standard and cooperating parts;

FIG. 3 is a sectional view taken along line 3—3 of FIG. 2;

FIG. 4 is a plan view of an optional wire anchoring link;

FIG. 5 is a side view of the link shown in FIG. 4;

FIG. 6 is a sectional view taken on line 6—6 of FIG. 5;

DETAILED DESCRIPTION

Figure 7:
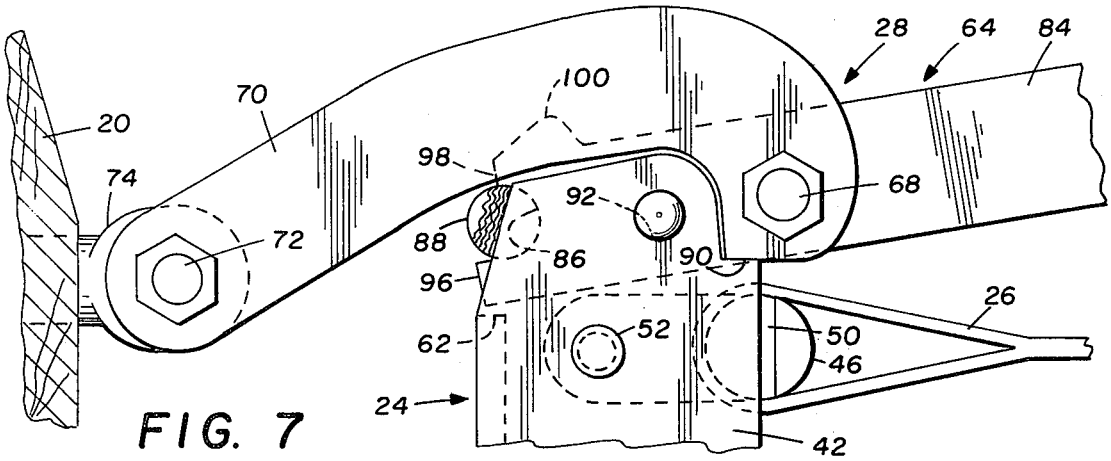
FIG. 7 is a fragmentary detailed side view of the upper part of the gate end standard and the traction mechanism of FIG. 1.

Referring now to the drawings, and particularly to FIGS. 1 and 2, there is shown a gate post 20 at the openable end of a closed gate 22 embodying the novel gate end standard 24 tensioning longitudinal gate wires 26 and being held in traction by a traction mechanism 28 at the top and by a seat bolt 30 at the bottom.

As shown in FIGS. 1, 2 and 3, the seat bolt 30 comprises a horizontal shaft 32 extending through the gate post 20 from a threaded end fitted with a washer and nut 34, and also comprises a vertical shank 36 integral therewith at the other end. This vertical shank has an upward projection 38 above the horizontal shaft 32 and extends downward and thence to an end embedded in the post 20 to prevent rotation of the horizontal shaft 32 and thus keep the projection 38 vertical.

The lower end of the gate end standard 24 is an angle member 40 which rests on the shaft 32 and partially encircles the upright projection 38 when the gate is in its closed position. Except for the angle member 40, the standard 24 is an open sided structural element comprising two broad parallel side walls 42 that are connected opposite the open side by a narrow perpendicular wall 44. The angle member 40 straddles the wall 44.

Each of the longitudinal wires 26 is looped around a drum 46 which may extend between the side walls 42 and may be secured directly thereto. However, the drum 46 is preferably incorporated into a link 48 having a pair of arms 50 adjacent the side walls 42. One end of each arm 50 is integral with the side of the drum while the other end is perforated and pivoted on a pin 52 extending through this perforation through perforations in the side walls 42.

Optional pivot links 54 shown in FIGS. 4, 5 and 6 can be substituted for pivot links 48. These optional pivot links can be produced by welding two equal stampings together side by side. Each stamping comprises one arm 56 with a perforation 58 and a cupped portion 60 forming one half of a drum-like terminal around which to loop the longitudinal wire 26. The drum can be shaped so as to center the wire.

Figure 8:
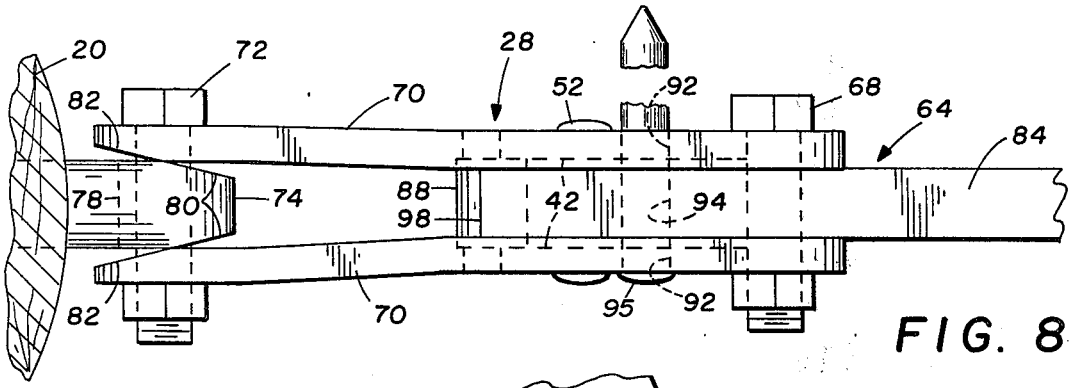
FIG. 8 is a plan view of the structure shown in FIG. 7.
Figure 9:
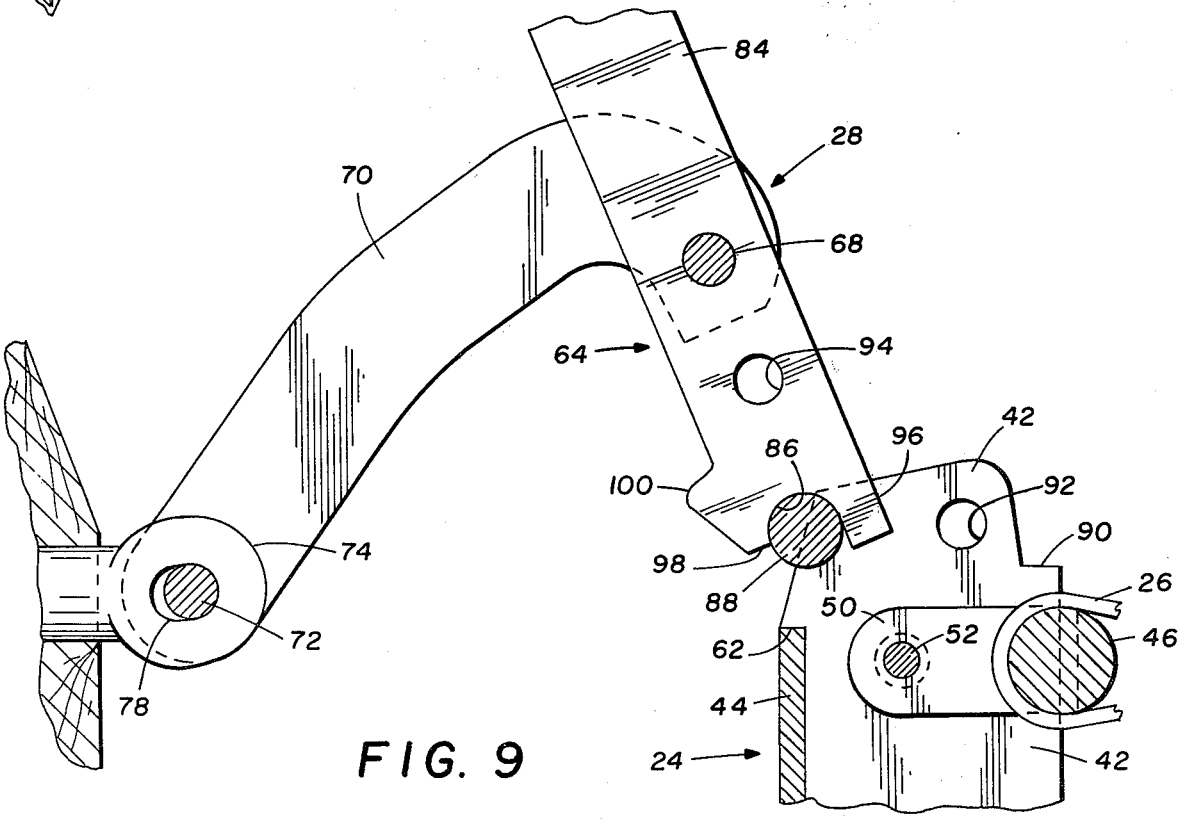
FIG. 9 is a view similar to FIG. 7 but with the traction lever in the upended position and with parts broken away.

At the upper end of the gate end standard 24 the narrow perpendicular side wall 44 is cut away at 62 as shown in FIGS. 7 and 9 to provide space for the traction lever 64 of a toggle type traction mechanism 28 shown also in FIG. 8. The traction lever is connected at its fulcrum by a pivot bolt 68 with a pair of traction links 70, the other ends of which are pivotally connected by means of a pivot bolt 72 with one end of an anchor bolt 74 extending through the supporting adjacent gate post 20, on the other side of which the anchor bolt is threaded and secured by a washer and nut 76 as shown in FIG. 1. Both the traction links and the anchor bolt are perforated for receiving the pivot bolt 72.

To provide some lateral movement for the standard 24 relative to the post 20 while the gate is in traction, the perforation 78 in the anchor bolt 74 is horizontally elongated as shown in FIGS. 8 and 9, and the ends of the anchor bolt and traction links are tapered at 80 and 82, respectively, on opposite sides of the pivot bolt 72, as shown in FIG. 8.

As shown in FIG. 1, one end of the traction lever constitutes a handle 84. In the closed gate the handle extends over the wire barrier of the gate. When the gate is open the handle overlies the top of the gate post 20. To increase the distance the overlying handle extends beyond the post, two sides of the post 20 are tapered above the anchor bolt 74 as shown.

The other end of the traction lever 64 defines the socket 86 for receiving and pivoting about a cylindrical block 88 bridging the space between the two broad parallel side walls 42 of the standard 24 above the point 62 where the narrow perpendicular wall 44 is cut away. Referring to FIG. 7, the pivot block 88 is mounted one half inside and one half outside the edge of the side walls 42 and then welded in the external angle between the block and each wall.

The width of the traction lever is less than the space between side walls 42 which is occupied by the traction lever when the gate is in its closed position. At the same time the two traction links 70 extend over the top of the side walls 42, being arched to accomplish this. The side walls 42 are curved to accommodate the arched traction links 70 and provide shoulders 90 adjacent the open side of the standard to engage the traction links 70 after the traction lever has been moved over center to a terminal position where perforations 92 in the side walls 44 register with a perforation 94 (FIG. 9) in the traction lever. Normally the gate is safely closed in traction when the traction lever 64 is at its over-center terminal position. However, for further security a pin 95 (FIG. 8) can be inserted through the perforations 92 and 94 thereby preventing both uplifting of the standard 24 and accidental opening of the gate.

The traction lever has a long fork 96 and a shorter fork 98 at its socket defining end to facilitate placement of the traction lever on the pivot block 72 as shown in FIG. 9. At the shorter fork 98 a bulge 100 in the adjacent side of the traction lever is provided to extend between and thus interlock with the traction links 70 when the traction mechanism is positioned over center as shown in FIG. 7. The two traction links 70 may be rigidly interconnected by a web of limited length if desired.

To close the gate, the lower end of the gate end standard 24 is first advanced and the angle member 40 is hooked to the upward projection 38 of the seat bolt 30. This connection is easy to make because of the width of the opening between the sides of the angle member. With one hand the operator then grasps and up-ends the traction lever 64 while employing the other hand to advance the top of the gate end standard within reach of the socket defining end of the traction lever. As the top of the standard is thus advanced the lower wires 26 are rendered taut and their tension causes the angle member 40 to pivot about the projection 38 so that the upper end of the standard is oriented alignable with the traction mechanism. The pivot block 88 is then engaged by the socket end of the traction lever as shown in FIG. 9 and the lever is moved over center to the terminal position shown in FIG. 7.

During the opening and closing of the gate, changes in the angle in the plane of the gate between the gate end standard 24 and the longitudinal gate wires 26 are made by the links 48 pivoting about the pins 52 without wear of the wires.

Although a preferred embodiment of the invention has been illustrated in the accompanying Drawings and described in the foregoing Detailed Description, it will be understood that the invention is not limited to the embodiment disclosed, but is capable of numerous rearrangements, substitutions, and modifications of parts and elements without departing from the spirit of the invention.

What is claimed is:

1. For use at the openable end of a wire traction gate in conjunction with a gate post and the wire barrier of the gate:

a gate end standard for supporting one end of said wire barrier and positionable adjacent said post in an upright position;

lower means for securing the lower end of said standard to said post, said lower means including a pivot extending horizontally outwardly from the post and a pivot extending vertically from the distal end of the horizontally extending pivot;

upper means for securing the upper end of said standard to said post; and an open sided angle member mounted on the gate end standard at the lower end thereof with the open side facing the standard for engaging said vertical pivot solely on the side thereof opposite the standard and engaging said horizontal pivot at the bottom, whereby said vertical pivot can be readily hooked by said angle member from above without necessitating precise alignment therebetween and will become unhooked if the upper end of said standard is allowed to drop and whereby said standard can be pivoted about said upstanding vertical pivot under the tension of the wire barrier, said angle member being readily disengagable from the vertical pivot upon relative lateral pivotal movement of the standard with respect thereto.

2. The structure according to claim 1 wherein said upstanding pivot is secured to a shaft which is in turn secured to said post in a horizontal manner, and wherein said angle member rests on said shaft when the gate end is in its upright position.

3. The structure described in claim 1 wherein said standard is comprised of a shaft and the angle member is secured thereto on the side facing said post and extends downwardly therefrom.

* * * * *